US010614984B2

(12) United States Patent
Kimura et al.

(10) Patent No.: US 10,614,984 B2
(45) Date of Patent: Apr. 7, 2020

(54) FUSE UNIT AND METHOD OF MANUFACTURING FUSE UNIT

(71) Applicant: Pacific Engineering Corporation, Ogaki-shi (JP)

(72) Inventors: Masahiro Kimura, Ogaki (JP); Toshihisa Iwakura, Ogaki (JP)

(73) Assignee: PACIFIC ENGINEERING CORPORATION, Ogaki-Shi (JP)

( * ) Notice: Subject to any disclaimer, the term of this patent is extended or adjusted under 35 U.S.C. 154(b) by 180 days.

(21) Appl. No.: 15/570,080

(22) PCT Filed: Sep. 9, 2016

(86) PCT No.: PCT/JP2016/076545
§ 371 (c)(1),
(2) Date: Oct. 27, 2017

(87) PCT Pub. No.: WO2017/175404
PCT Pub. Date: Oct. 12, 2017

(65) Prior Publication Data

US 2018/0122607 A1 May 3, 2018

(30) Foreign Application Priority Data

Apr. 6, 2016 (JP) ..... 2016-076373

(51) Int. Cl.
*H01H 69/02* (2006.01)
*H01H 85/175* (2006.01)
(Continued)

(52) U.S. Cl.
CPC ..... *H01H 69/02* (2013.01); *H01H 85/143* (2013.01); *H01H 85/175* (2013.01);
(Continued)

(58) Field of Classification Search
CPC ..... H01H 69/02; H01H 85/143; H01H 85/20; H01H 85/175; H01H 2085/0034;
(Continued)

(56) References Cited

U.S. PATENT DOCUMENTS 5,841,338 A * 11/1998 Yasukuni ..... H01H 85/0411 337/293
6,509,824 B2 * 1/2003 Inaba ..... H01H 85/044 29/623
6,566,599 B2 * 5/2003 Sumida ..... H01H 85/044 29/623

FOREIGN PATENT DOCUMENTS

JP 2001160347 A 6/2001
JP 2002358864 A 12/2002
(Continued)

OTHER PUBLICATIONS

International Search Report for PCT/JP2016/076545 dated Nov. 15, 2016 with English translation (4 pages).

*Primary Examiner* — Donghai D Nguyen
(74) *Attorney, Agent, or Firm* — Shumaker, Loop & Kendrick, LLP

(57) ABSTRACT

The present invention provides a fuse unit which facilitates a work such as inspection and a method of manufacturing the fuse unit. Disclosed is a method of manufacturing a fuse unit, which has a metal part including an input terminal and an external connection terminal and a connector part for attaching an external terminal C3 to the external connection terminal and is manufactured by integrating the metal part and a resin covering body by insert molding. In this manufacturing method, the metal part and the resin covering body are integrated by insert molding such that a distal end of the external connection terminal of the metal part protrudes from the resin covering body, and then, the connector part separate from the resin covering body is attached to the resin
(Continued)

covering body so that the external connection terminal protruding from the resin covering body can be connected to the external terminal C3.

2 Claims, 11 Drawing Sheets

(51) Int. Cl.
*H01H 85/20* (2006.01)
*H01H 85/143* (2006.01)
*H01H 85/00* (2006.01)
*H01H 85/02* (2006.01)
*H01H 85/055* (2006.01)

(52) U.S. Cl.
CPC ..... *H01H 85/20* (2013.01); *H01H 2085/0034* (2013.01); *H01H 2085/025* (2013.01); *H01H 2085/0555* (2013.01)

(58) Field of Classification Search
CPC ..... H01H 2085/0555; H01H 2085/025; Y10T 29/49107; Y10T 29/49128
USPC ..... 29/623, 831
See application file for complete search history.

(56) References Cited

FOREIGN PATENT DOCUMENTS

| | | | |
|---|---|---|---|
| JP | 2005339965 | A | 12/2005 |
| JP | 2013126285 | A | 6/2013 |

* cited by examiner

FUSE UNIT AND METHOD OF MANUFACTURING FUSE UNIT

TECHNICAL FIELD AND BACKGROUND

The present invention relates to a fuse unit to be used mainly for, for example, an electric circuit for an automobile, and relates particularly to a fuse unit in which a metal part and a resin covering body are integrated by insert molding, and a method of manufacturing the fuse unit.

In the prior art, fuse units have been used to protect an electric circuit mounted in an automobile or the like and various electric components connected to the electric circuit. Specifically, when an unintended overcurrent flows in the electric circuit, a fusing portion fuses due to heat generated by overcurrent to protect the various electric components so as not to allow excess current to flow through the electric components.

There are various kinds of fuse units depending on the application, and, for example, the fuse unit described in Patent Literature 1 is used for connecting an on-board battery and electric wires supplying power to various electric components. In such an on-board fuse unit, there is a possibility that metal parts are damaged by vibration of a vehicle body. Thus, a resin is poured and insert-molded in a state where the metal part is disposed in a molding die, whereby the metal part and a resin covering body are integrated to avoid damage of the metal parts due to vibration.

The fuse unit may be provided with a connector portion used for attaching an external terminal from the outside. More specifically, as shown in a fuse unit 800 in FIGS. 6(*a*) to 6(*c*), the fuse unit 800 is formed by integrating a metal part 700 and a resin covering body 810 by insert molding, and the metal part 700 inside the resin covering body 810 is constituted of a connection-side terminal plate 710, an input terminal plate 720, and an external connection terminal 740. As shown in FIG. 6(*c*), a connector portion 900 is formed so as to surround a periphery of the external connection terminal 740. When an external terminal connector C2 provided with an external terminal C1 as a female terminal is attached so as to be fitted in the connector portion 900, the external connection terminal 740 is inserted into the external terminal C1, and both terminals are connected.

Here, a method of manufacturing the fuse unit 800 including the metal part 700 will be described. First, the metal part 700 is placed on a fixed side mold plate (not shown), and a movable side mold plate is mated with the fixed side mold plate from above of the metal part 700 to form a cavity. Then, when a resin is injected into the cavity, the fuse unit 800, as shown in FIGS. 6(*a*) to 6(*c*), in which the metal part 700 and the resin covering body 810 are integrated is completed. At that time, the connector portion 900 is molded integrally with the resin covering body 810.

However, as shown in FIG. 6(*c*), since the periphery of the external connection terminal 740 is surrounded by the connector part 900, it is difficult to connect inspection equipment or the like to the external connection terminal 740, and this causes difficulty in inspection of the fuse unit 800.

CITATIONS LIST

Patent Literatures

Patent Literature 1: JP-A 2005-339965

SUMMARY

The present invention provides a fuse unit which facilitates a work such as inspection and a method of manufacturing the fuse unit.

A method of manufacturing a fuse unit according to the present invention is a method of manufacturing a fuse unit, which has a metal part including an input terminal and an external connection terminal and a connector part for attaching an external terminal to the external connection terminal and is manufactured by integrating the metal part and a resin covering body by insert molding. In this manufacturing method, the metal part and the resin covering body are integrated by insert molding such that a distal end of the external connection terminal of the metal part protrudes from the resin covering body, and then, the connector part separate from the resin covering body is attached to the resin covering body so that the external connection terminal protruding from the resin covering body can be connected to the external terminal.

According to the above feature, since the metal part and the resin covering body are integrated by insert molding in a state where the distal end of the external connection terminal of the metal part protrudes from the resin covering body, inspection equipment or the like can be easily connected to the external connection terminal protruding from the resin covering body to the outside. Thus, it is possible to easily perform inspection and measurement work of the fuse unit. When the inspection and measurement work of the fuse unit is terminated, a separate connector part needs only be attached to the resin covering body, so that an external terminal connector can be inserted and attached as before.

Further, in the method of manufacturing a fuse unit according to the present invention, the metal part includes a plurality of the external connection terminals, the distal ends of the external connection terminals are connected to each other by a connecting portion, and the metal part and the resin covering body are integrated by insert molding such that the distal end of the external connection terminal of the metal part and the connecting portion protrude from the resin covering body. Then, the connecting portion of the external connection terminal protruding from the resin covering body is cut and removed.

According to the above feature, since the distal ends of the external connection terminals are connected to each other by the connecting portion, when the metal part and the resin covering body are integrated by insert molding, the external connection terminals are not deformed or deviated from each other, so that occurrence of defective products can be prevented. Since the connecting portion is cut and removed after insert molding, the connecting portion does not become an obstacle when a separate connector part is attached to the resin covering body.

A fuse unit according to the present invention is a fuse unit, which has a metal part including an input terminal and an external connection terminal and a connector part for attaching an external terminal to the external connection terminal and in which the metal part and a resin covering body are integrated. In this fuse unit, a distal end of the external connection terminal of the metal part protrudes from the resin covering body, and the connector part separate from the resin covering body is attached to the resin covering body so that the external connection terminal can be connected to the external terminal.

According to the above feature, inspection equipment or the like can be easily connected to the external connection terminal protruding from the resin covering body to the outside, and it is possible to easily perform inspection and measurement work of the fuse unit. When the inspection and measurement work of the fuse unit is terminated, a separate connector part needs only be attached to the resin covering body, so that an external terminal connector can be inserted and attached as before.

Advantageous Effects of Invention

As described above, according to the fuse unit and the method of manufacturing a fuse unit according to the present invention, a work such as inspection of the fuse unit is facilitated.

DETAILED DESCRIPTION

Hereinafter, embodiment of the present invention will be described with reference to the drawings. The embodiment to be described below exemplifies shapes and materials of respective members included in a fuse unit and will not be limited to the exemplified shapes and materials. In this specification, a "front/front side" is a side where a fuse connection terminal 130 protrudes in a front view of a metal part 100 shown in FIG. 1(*a*). A "back/back side" is opposite to the "front/front side". Further, in this specification, a "lower/lower side" is a side where a distal end of an external connection terminal 140 extends (a side where a connecting portion 150 is formed) in the front view of the metal part 100 shown in FIG. 1(*a*), and an "upper/upper side" is opposite to the "lower/lower side".

Figure 1B:
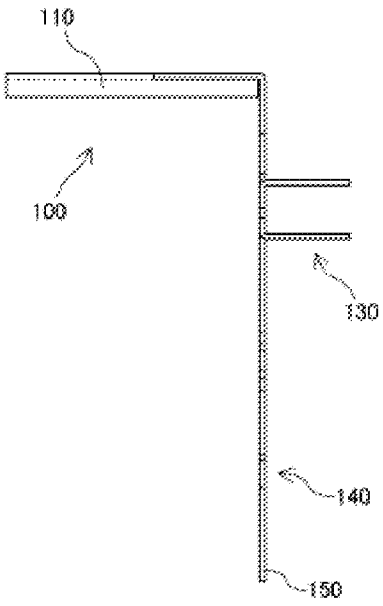
FIG. 1(*a*) is a front view of a metal part of a fuse unit of the present invention, FIG. 1(*b*) is a side view of the metal part, and FIG. 1(*c*) is a plan view of the metal part.
Figure 1A:
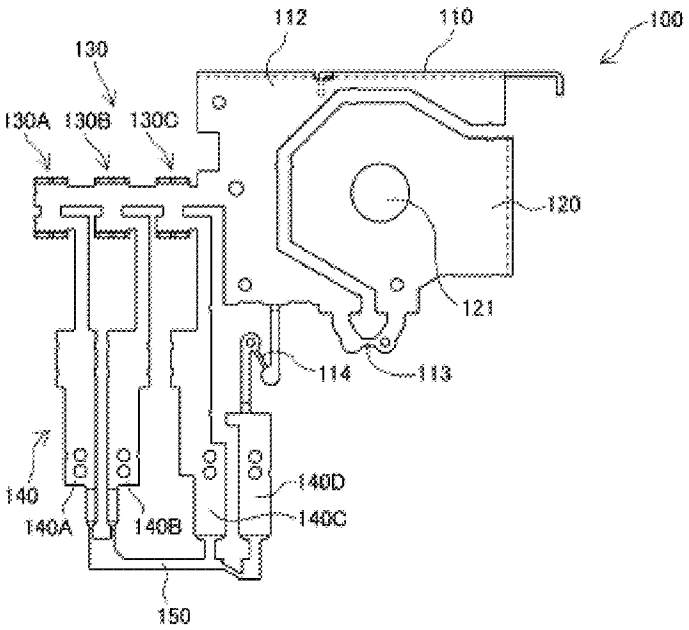
Figure 1C:
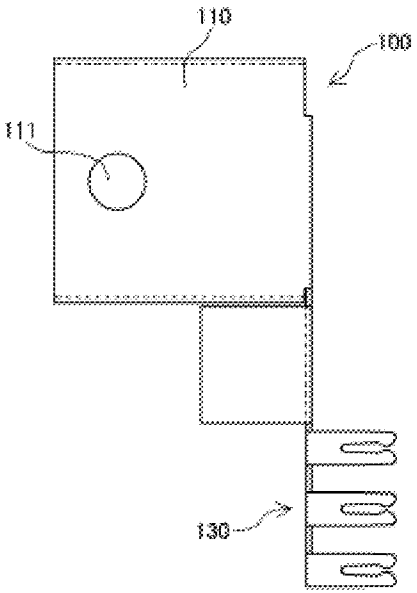

FIGS. 1(*a*) to 1(*c*) show the metal part 100 of the fuse unit according to the present invention. The metal part 100 is formed from a single thin plate-like metal plate and constituted of an energizable input terminal 110, a connection side terminal plate 120, a plurality of fuse connection terminals (130A to 130C), and a plurality of external connection terminals (140A to 140D). The input terminal 110 is connected to a circuit portion 112, and the connection side terminal plate 120 is connected to the circuit portion 112 via a fusing portion 113. Thus, if an overcurrent flows from a power source side connected to a stud bolt hole 111 of the input terminal 110, the fusing portion 113 fuses, so that it is possible to protect loads of various electric components and the like connected to a connecting bolt hole 121 of the connection side terminal plate 120.

One end of each fuse connection terminal (130A to 130C) is connected to the circuit portion 112, and the other end is connected to each corresponding external connection terminal (140A to 140C). Thus, if an overcurrent flows from the power source side connected to the stud bolt hole 111 of the input terminal 110, a fusing portion (not shown) of a fuse attached to each of the fuse connection terminals 130 fuses, so that a load connected to each of the external connection terminals 140 can be protected. The external connection terminal 140D is connected to the circuit portion 112 via a fusing portion 114. Thus, if an overcurrent flows from the power source side connected to the stud bolt hole 111 of the input terminal 110, the fusing portion 114 fuses, so that it is possible to protect a load connected to the external connection terminal 140D.

All distal ends of the external connection terminals (140A to 140D) are connected to each other by the connecting portion 150. As will be described later, the connecting portion 150 is cut and removed, so that only the distal ends of the respective external connection terminals (140A to 140D) remain so as to protrude from an end surface of a resin covering body.

Next, a method of forming the metal part 100 will be briefly described. First, a flat plate-like member formed of a conductive metal such as copper or its alloy and having a uniform thickness is punched out into a predetermined shape with a press machine or the like. Then, when the input terminal 110 is folded by approximately 90 degrees and the fuse connection terminal 130 is also folded by approximately 90 degrees, the metal part 100 shown in FIGS. 1(*a*) to 1(*c*) is completed.

Figure 2B:
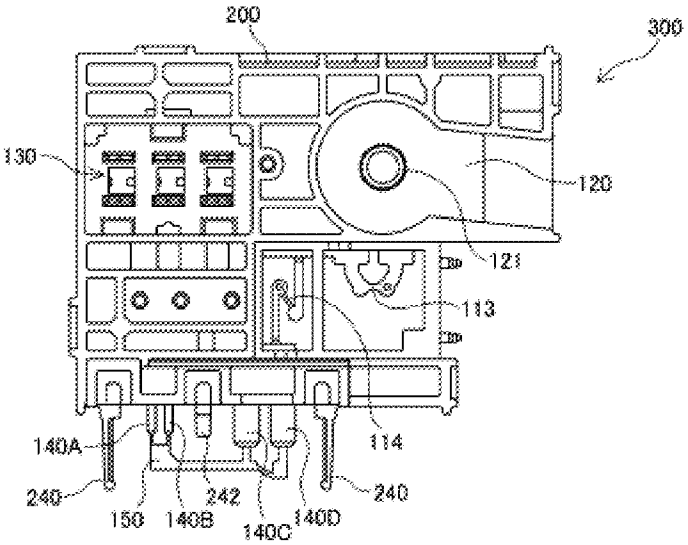
FIG. 2(*a*) is a lateral conceptual diagram showing a state in which the metal part and a resin covering body of the fuse unit of the present invention are integrated by insert molding, and FIGS. 2(*b*) and 2(*c*) are front views of the fuse unit of the present invention.
Figure 2A:
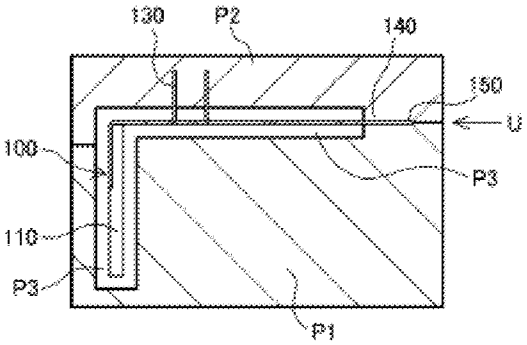
Figure 2C:
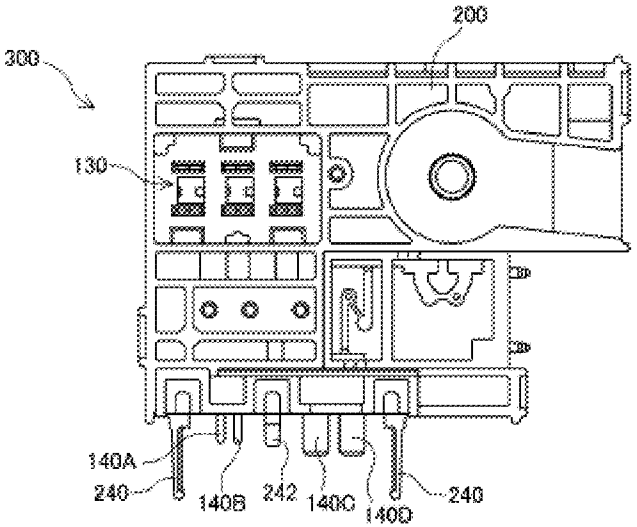

Next, a method of manufacturing a fuse unit 300 will be described with reference to FIG. 2(*a*). First, the metal part 100 shown in FIGS. 1(*a*) to 1(*c*) is placed on a fixed side mold plate P1 as it is such that a back surface side of the metal part 100 faces the fixed side mold plate P1. Then, a movable side mold plate P2 is mated with the fixed side mold plate P1 from the front side of the metal part 100, a cavity P3 is formed around the metal part 100, and a resin is injected into the cavity P3. Then, as shown in FIG. 2(*b*), the metal part 100 and the resin covering body 200 are integrated while the front side and the back side of the metal part 100 are covered with the resin covering body 200. In this manner, the fuse unit 300 in which the metal part 100 and the resin covering body 200 are integrated by insert molding is manufactured. A material constituting the resin covering body 200 is an insulating resin which is melted at the time of injection and then can be cooled and hardened.

As shown in FIG. 2(*a*), while the fixed side mold plate P1 and the movable side mold plate P2 are mated with each other, the cavity P3 is not formed at the distal end of the external connection terminal 140 of the metal part 100 and around the connecting portion 150. Thus, as shown in FIG. 2(*b*), in the manufactured fuse unit 300, the distal end of the external connection terminal 140 and the connecting portion 150 are in a state of protruding from a lower end side of the resin covering body 200.

Although not illustrated, the stud bolt hole 111 of the input terminal 110 is exposed at an upper end side of the resin covering body 200 in order to connect to the power source side. As shown in FIG. 2(*b*), the connection side terminal plate 120 is exposed from a portion of a surface of the resin covering body 200, so that a load can be connected. In order to attach a connector part, which will be described later, to the resin covering body 200, locking claws 240 protrude from a lower end surface of the resin covering body 200, and the locking claws 240 are formed integrally with the resin covering body 200 at the time of the insert molding described above.

Figure 3A:
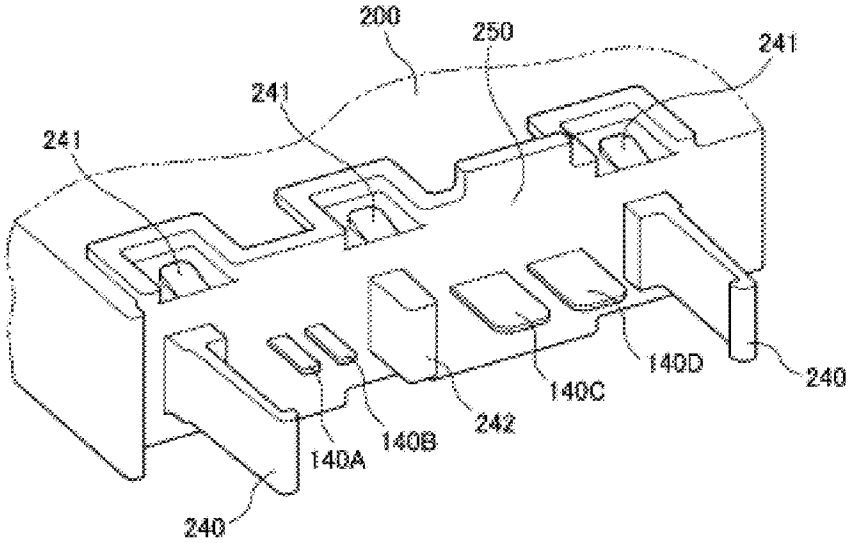
FIG. 3(*a*) is an enlarged perspective view showing a periphery of an external connection terminal of the fuse unit of the present invention, and FIG. 3(*b*) is an enlarged bottom view showing the periphery of the external connection terminal.
Figure 3B:
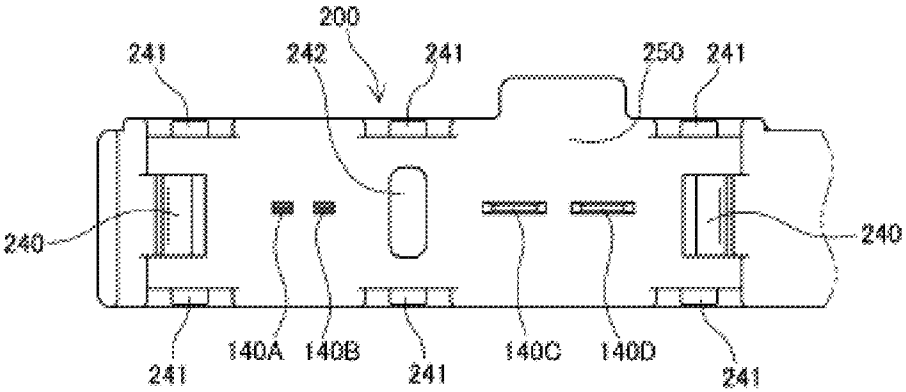

Then, as shown in FIG. 2(*c*), after the insert molding, when the resin covering body 200 is cooled and solidified, the connecting portion 150 is cut and removed with a tool or the like. Then, as shown in FIGS. 3(*a*) and 3(*b*), the connecting portion 150 is cut and removed, and only the distal end of the external connection terminal 140 remains, so that the external connection terminals (140A to 140D) are in a state of protruding from a lower end surface 250 of the resin covering body 200.

A plurality of locking claws 241 are formed at an edge portion of the end surface 250. A pair of the external connection terminal 140A and the external connection terminal 140B is connected to an external terminal connector C4 to be described later, and a pair of the external connection terminal 140C and the external connection terminal 140D is connected to an external terminal connector C6 to be described later.

Figure 4B:
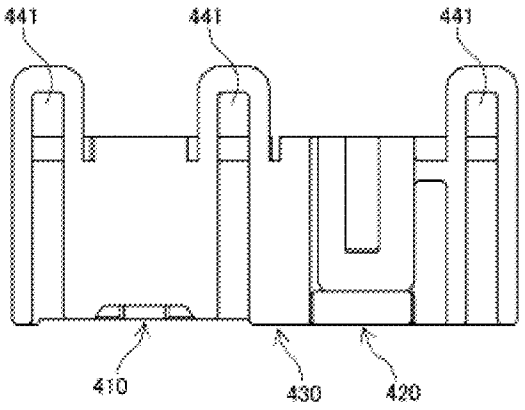
FIG. 4(*a*) is a perspective view of a connector part to be attached to the fuse unit of the present invention, FIG. 4(*b*) is a front view of the connector part, and FIG. 4(*c*) is a bottom view of the connector part.
Figure 4A:
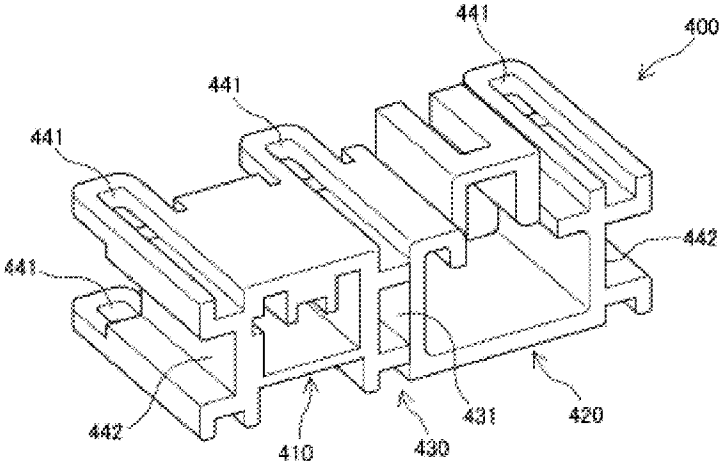
Figure 4C:
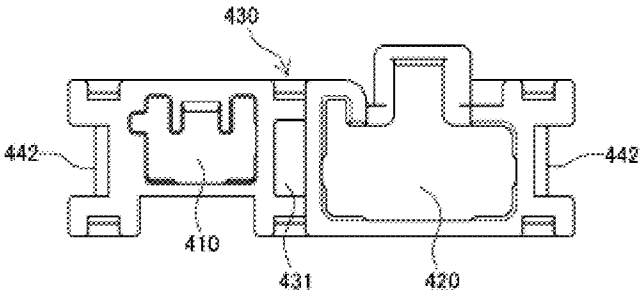

Here, a detailed configuration of the connector part 400 engaged with the locking claws 240 and 241 will be described with reference to FIGS. 4(*a*) to 4(*c*). As shown in FIGS. 4(*a*) to 4(*c*), the connector component 400 is mainly constituted of a first opening 410, a second opening 420, and a partition wall 430, and the whole is integrally molded with an insulating resin. The connector part 400 is individually manufactured as a separate body from the resin covering body 200.

A shape of an inner surface of the first opening 410 coincides with a shape of an outer surface of the external terminal connector C4 to be described later such that the external terminal connector C4 is inserted into and attached to the first opening 410. Similarly, a shape of an inner surface of the second opening 420 coincides with a shape of an outer surface of the external terminal connector C6 to be described later such that the external terminal connector C6 is inserted into and attached to the second opening 420. The partition wall 430 partitions between the first opening 410 and the second opening 420, and an insertion opening 431 into which an insertion portion 242 (see FIGS. 3(*a*) and 3(*b*)) of the resin covering body 200 can be inserted is formed at a central portion of the partition wall 430. A plurality of locking holes 441 are formed in the connector part 400, and locking grooves 442 are formed on both side surfaces of the connector part 400.

Figure 5B:
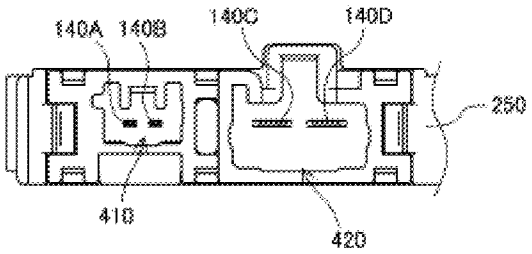
FIG. 5(*a*) is a perspective view showing a state in which the connector part is attached around the external connection terminal of the fuse unit of the present invention, FIG. 5(*b*) is a bottom view of a state where the connector part is attached around the external connection terminal, and FIG. 5(*c*) is a perspective view showing a state where an external terminal connector is attached to the connector part from the outside.
Figure 5A:
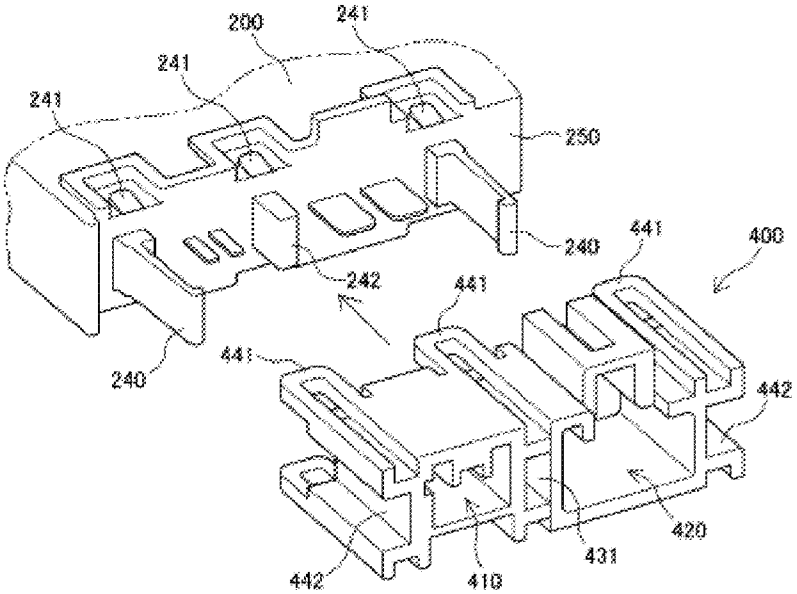
Figure 5C:
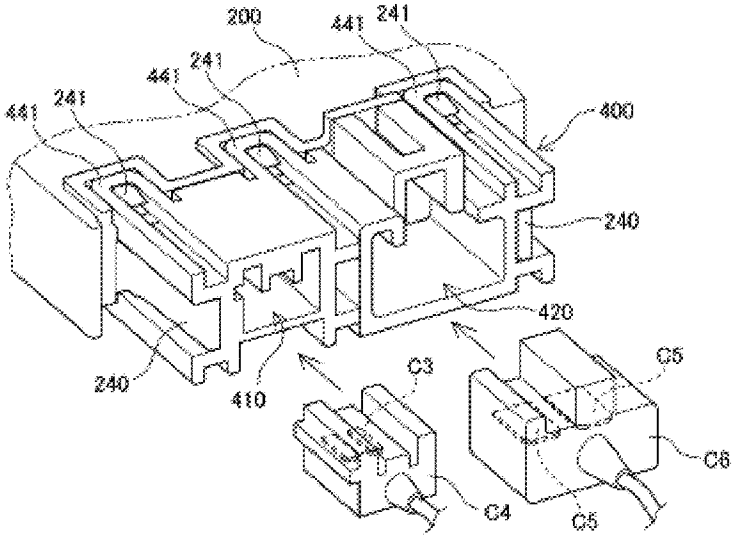
Figure 6B:
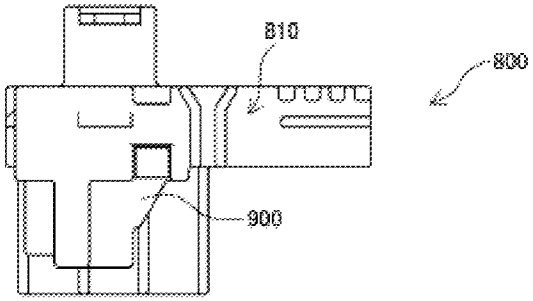
FIG. 6(*a*) is a front view of a fuse unit of the prior art according to the present invention, FIG. 6(*b*) is a side view of the fuse unit, and FIG. 6(*c*) is an enlarged perspective view of a periphery of a connector part of the fuse unit.
Figure 6A:
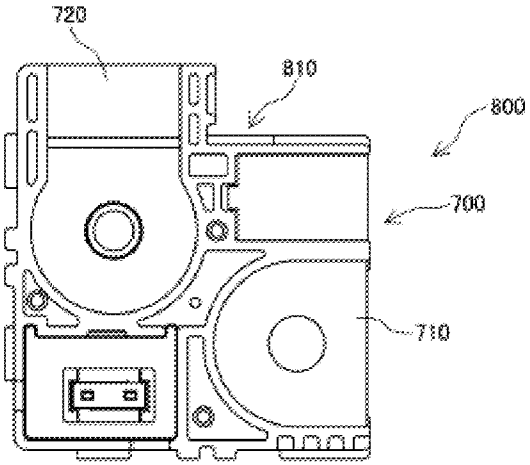
Figure 6C:
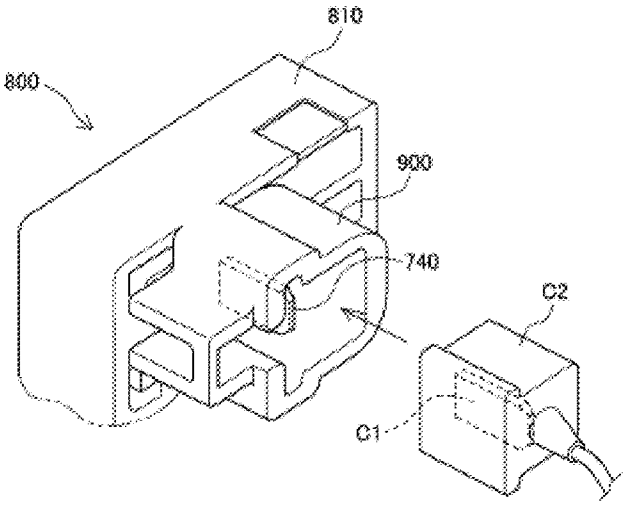

Next, with reference to FIGS. 5(*a*) to 5(*c*), attachment of the connector part 400 to the resin covering body 200 will be described (however, a work such as inspection, which will be described later, is performed with respect to the fuse unit 300 in a state before attaching the connector part 400). As shown in FIG. 5(*a*), the connector part 400 is brought close to the end surface 250 of the resin covering body 200, the locking claws 241 of the resin covering body 200 are locked to the respective locking holes 441 of the connector part 400, and the locking claws 240 of the resin covering body 200 are locked to the respective locking grooves 442 of the connector part 400. The connector part 400 is attached to the resin covering body 200 after a position of the connector part 400 is aligned such that the insertion portion 242 of the resin covering body 200 is inserted into the insertion opening 431 of the connector part 400.

Then, as shown in FIG. 5(*b*), the external connection terminals 140A and 140B are surrounded by the first opening 410, and the external connection terminals 140C and 140D are surrounded by the second opening 420. In this way, the connector part 400 is attached to the resin covering body 200, and the manufacture of the fuse unit 300 is completed.

An external terminal connector can be inserted into the completed fuse unit 300 depending on the application when used. Specifically, as shown in FIG. 5(*c*), when the external terminal connector C4 provided with an external terminal C3 is inserted from the outside into the first opening 410 and attached thereto, the external connection terminals 140A and 140B are connected to the external terminal C3 which is a female terminal. Similarly, when the external terminal connector C6 provided with an external terminal C5 is inserted from the outside into the second opening 420 and attached thereto, the external connection terminals 140C and 140D are connected to the external terminal C5 which is a female terminal.

The external terminals C3 and C5 connected to the respective external connection terminals 140 are connected to an external load or the like. Even when an overcurrent flows from the battery power source side, each corresponding fusing portion (not shown) fuses, so that a load connected via the external terminals C3 and C5 can be protected.

As described above, according to the method of manufacturing the fuse unit 300 according to the present invention, in a state where the distal end of the external connection terminal 140 of the metal part 100 protrudes from the resin covering body 200, the metal part 100 and the resin covering body 200 are integrated by insert molding. Thus, since inspection equipment or the like can be easily connected to the external connection terminal 140 protruding from the resin covering body 200 to the outside, it is possible to easily perform inspection and measurement work of the fuse unit 300. When the inspection and measurement work of the fuse unit 300 is terminated, the separate connector part 400 needs only to be attached to the resin covering body 200, so that an external terminal connector can be inserted and attached as before. In the inspection, for example, it is assumed that inspection equipment is connected to the input terminal 110 on an input side and the external connection terminal 140 on an output side to confirm conduction.

Further, according to the method of manufacturing the fuse unit 300 according to the present invention, since the distal ends of the external connection terminals 140 are connected to each other by the connecting portion 150, when the metal part 100 and the resin covering body 200 are integrated by insert molding, the external connection terminals 140 are not deformed or deviated from each other, so that occurrence of defective products can be prevented. Since the connecting portion 150 is cut and removed after insert molding, the connecting portion 150 does not become an obstacle when the separate connector part 400 is attached to the resin covering body 200. Particularly, since the connecting portion 150 is provided at the distal end of the external connection terminal 140 and protrudes outside so as not to be covered with the resin covering body 200 at the time of insert molding, the connecting portion 150 can be easily cut and removed.

In the fuse unit 300 of the present invention, the external connection terminal 140 protrudes laterally from the lower end side of the resin covering body 200. As shown in FIG. 2(*a*), the cavity P3 is formed by sandwiching the fixed side mold plate P1 and the movable side mold plate P2 from both front and back surfaces of the metal part 100 of the fuse unit 300. Since the mold plates have such a configuration, if the connector part 400 is integrally molded with the resin covering body 200 as in the prior art, in order to form the first opening 410 and the second opening 420 which open to the side of the connector part 400, a placing piece should be manually attached from the side of the resin covering body 200 (see the arrow U in FIG. 2(*a*)). However, since the temperatures of the fixed side mold plate P1 and the movable side mold plate P2 become high, it is dangerous to attach and detach the placing piece.

When attempting to form the first opening 410 and the second opening 420 which open toward the side by the fixed side mold plate P1 and the movable side mold plate P2, an undercut portion is formed, so that installation of the placing piece is an indispensable work. The "side (lateral side)" means a direction (see the arrow U in FIG. 2(*a*)) orthogonal to the direction in which the fixed side mold plate P1 and the movable side mold plate P2 are mated with each other so as to sandwich the metal part 100 in between.

However, the method of manufacturing the fuse unit 300 according to the present invention is a method of manufacturing in advance the connector part 400 as a separate body without integrally molded with the resin covering body 200, and, after forming the resin covering body 200, attaching the connector part 400 to the resin covering body 200, and therefore, the placing piece may not be used. Thus, it is possible to eliminate the dangerous work of attaching and detaching the placing piece. Since the work of attaching and detaching the placing piece becomes unnecessary, the operation tact is enhanced, and the manufacturing cost can be reduced.

In the state where the distal ends of the external connection terminals 140 are connected to each other by the connecting portion 150, when the placing piece is attached from the side at the time of insert molding, the connecting portion 150 and the placing piece will interfere with each other, so that it becomes difficult to attach the placing piece. That is, in the case of the conventional method of manufacturing a fuse unit using the placing piece, there is a problem that it is difficult to provide the connecting portion 150.

However, since the method of manufacturing the fuse unit 300 according to the present invention is, as described above, a method of attaching the separate connector part 400 to the resin covering body 200, the placing piece may not be used. Thus, it is possible to provide the connecting portion 150.

Further, the fuse unit and the method of manufacturing the fuse unit according to the present invention are not limited to the above-mentioned embodiment, and various modifications and combinations can be performed within a range of claims and within a range of the embodiment. These modifications and combinations are also included in the range of rights.

REFERENCE SIGNS LIST

100 Metal part
110 Input terminal
140 External connection terminal
200 Resin covering body
300 Fuse unit
400 Connector part
C3, C5 External terminal

The invention claimed is:

1. A method of manufacturing a fuse unit, which has a metal part comprising:

an input terminal a plurality of external connection terminals and a connector part for attaching an external terminal to the external connection terminals and is manufactured by integrating the metal part and a resin covering body by insert molding, wherein distal ends of the external connection terminals are connected to each other by a connection portion, the fuse unit manufacturing method comprising:

integrating the metal part and the resin covering body by insert molding such that the distal ends of the external connection terminals of the metal part and the connection portion protrude from the resin covering body, and the resin covering body comprises an insertion portion for inserting into an insertion opening of the connector part between the external connection terminals, and a connection portion extends towards the distal end of the external connection terminal so as to connect the distal ends of the external connection terminals each other by overpassing over the insertion portion, after the integration, cutting and removing the connection portion of the external connection terminal protruding from the resin covering body, and attaching the connector part, which is separate from the resin covering body, to the resin covering body so that the external connection terminals protrude from the resin covering body and configure to be connected the external terminal.

2. A part which constitutes a fuse unit, the part comprising:

a metal part comprising an input terminal and a plurality of external connection terminals, and a resin covering body integrated to the metal part, wherein distal ends of the external connection terminals are connected to each other by a connection portion, and the distal end of the external connection terminal of the metal part and the connection portion protrudes from the resin covering body, and the resin covering body comprises an insertion portion inserted into an insertion opening of a connector part for attaching an external terminal to the external connection terminals between the external connection terminals, the connection portion extends towards the distal end of the external connection terminal so as to connect the distal ends of the external connection terminals each other by overpassing over the insertion portion, the connection part is cut and removed after the resin cover body is integrated to the metal part so as to attach the connector part separate from the part constituting the fuse unit to the resin covering body and connect to the external connection terminals.

* * * * *